US006234608B1

(12) United States Patent
Genovese et al.

(10) Patent No.: US 6,234,608 B1
(45) Date of Patent: May 22, 2001

(54) MAGNETICALLY ACTUATED INK JET PRINTING DEVICE

(75) Inventors: Frank C. Genovese, Fairport; Joel A. Kubby, Rochester, both of NY (US); Eric Peeters, Mountain View, CA (US); Jinkuang Chen, Michigan, MI (US); Dan A. Hays, Fairport, NY (US); Stephen F. Pond, Gainesville, VA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 08/869,946

(22) Filed: Jun. 5, 1997

(51) Int. Cl.[7] ..... B41J 2/04
(52) U.S. Cl. ..... 347/54
(58) Field of Search ..... 347/54, 55, 103, 347/17, 120, 111, 159, 141, 128, 20, 28, 53, 68, 69, 70, 71, 72, 50, 40; 349/261; 361/700; 29/890.1; 310/328–330

(56) References Cited

U.S. PATENT DOCUMENTS

| | | | | |
|---|---|---|---|---|
| 5,322,594 | | 6/1994 | Bol | 156/634 |
| 5,818,473 | * | 10/1998 | Fujii et al. | 347/54 |
| 5,854,644 | * | 12/1998 | Eun | 347/54 |
| 5,889,541 | * | 12/1998 | Bobrow et al. | 347/54 |

FOREIGN PATENT DOCUMENTS

| | | |
|---|---|---|
| 04129744 | 4/1992 | (EP) . |
| 04129745 | 4/1992 | (EP) . |
| 04327945 | 11/1992 | (EP) . |
| 0 580 283 | 1/1994 | (EP) . |
| 96/32285 | 10/1996 | (WO) . |

* cited by examiner

*Primary Examiner*—John Barlow
*Assistant Examiner*—Raquel Yvette Gordon

(57) ABSTRACT

A magnetically actuated ink jet printing device for use in an ink jet printer ejects ink droplets by deforming a diaphragm with the force generated on an electrode in a magnetic field when an electric current pulse is applied thereto. In one embodiment, the diaphragm of the device is provided by anisotropically etching a silicon substrate with an etch stop which provides a thin membrane of silicon material for use as the diaphragm. An electrode having an input and output terminal is patterned over the diaphragm and a sacrificial layer is deposited over the silicon substrate surface containing the diaphragm. The sacrificial layer is patterned to subsequently provide the ink ejection chamber over the diaphragm. A patternable layer is deposited over the silicon substrate surface including the sacrificial layer and patterned to provide the nozzles and expose the electrode terminals. The sacrificial layer is removed and an ink supply is connected to the space previously occupied by the sacrificial layer. Magnetic field generating means having a predetermined magnetic field strength are placed adjacent the device, and electric current applied to the electrode terminals in a predetermined direction relative to the magnetic field produces a force necessary to deform the diaphragm and eject an ink droplet from the nozzles of the printing device.

27 Claims, 11 Drawing Sheets

FIG. 6
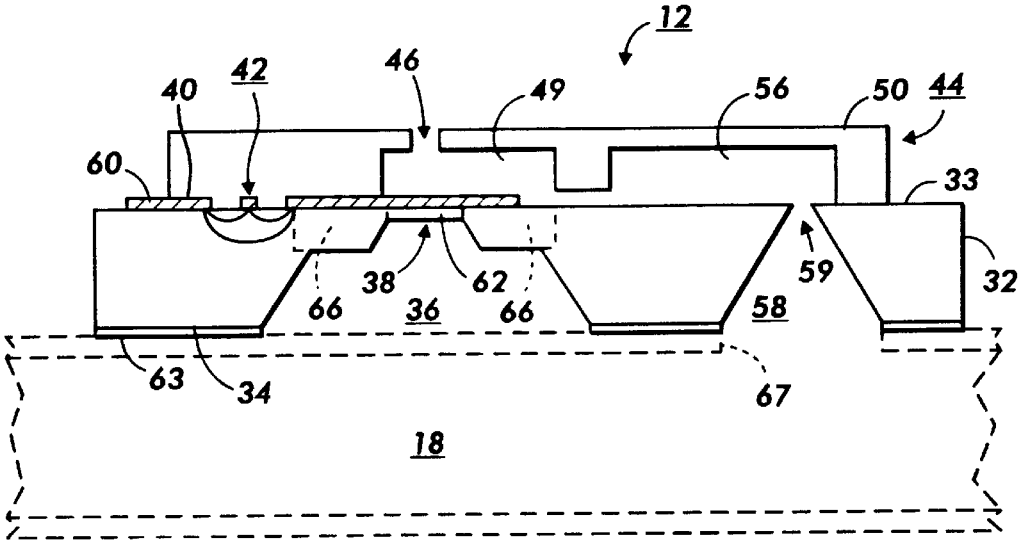
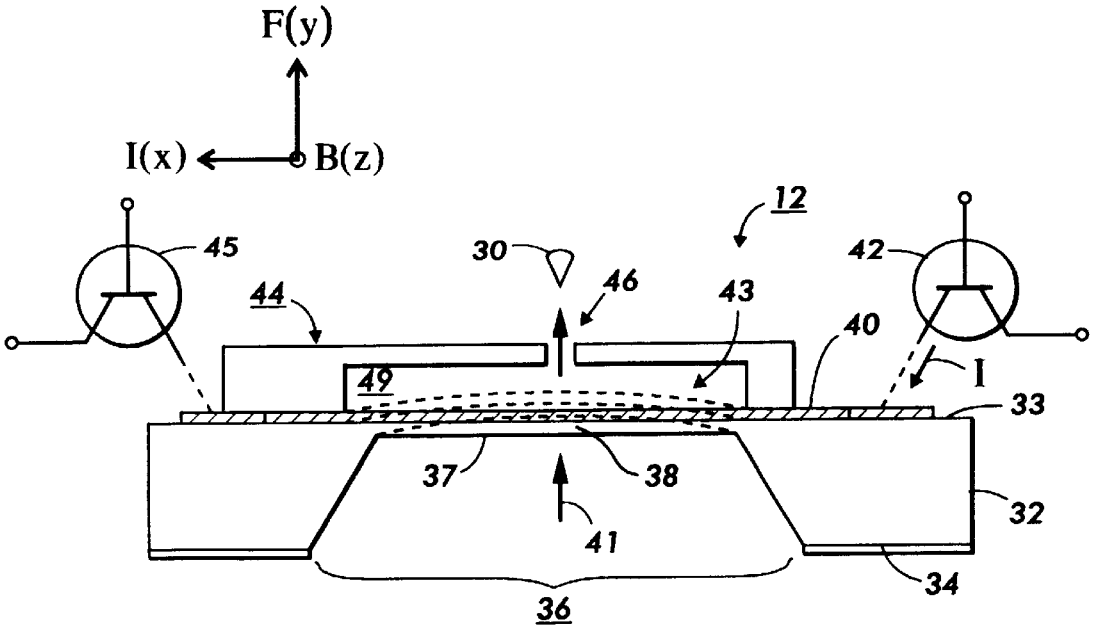
FIG. 7

FIG. 10
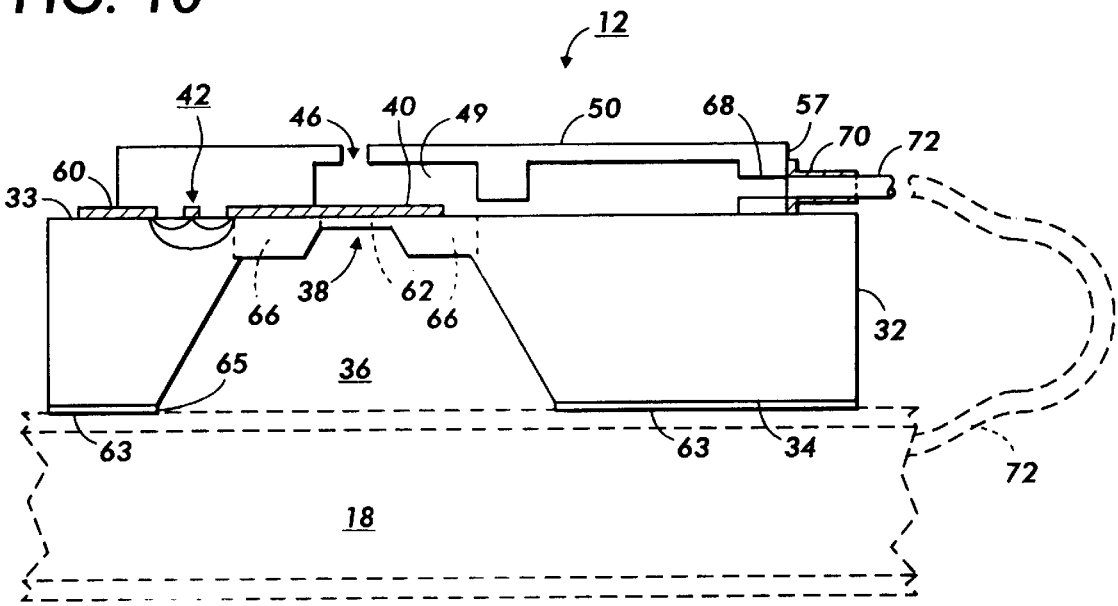
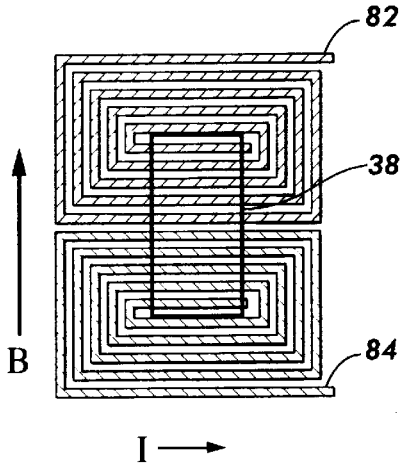
FIG. 13

MAGNETICALLY ACTUATED INK JET PRINTING DEVICE

BACKGROUND OF THE INVENTION

This invention relates to ink jet printheads and more particularly to droplet-on-demand ink jet printheads having magnetically actuated means for ejecting ink droplets.

The droplet-on-demand type of ink jet printheads are generally categorized by the means used to eject the ink droplets; viz., thermal ink jet or bubble jet, piezoelectric ink jet, and acoustic ink jet. In thermal ink jet, a water based ink is used and a heating element adjacent a nozzle momentarily vaporizes the ink in contact with the heating element in response to electric pulses applied to the heating element. Once a vapor bubble is nucleated, the vapor bubble expansion and contraction initiates a drop ejection process which continues independently of any additional electrical control signals, and thus there is no mechanism for control of the drop volume as might be desirable for variable drop-size greyscale control, except for varying the printhead or ink temperature which is difficult to control. For an example of thermal ink jet printheads, refer to U.S. Pat. No. 4,638,337. The piezoelectric ink jet printheads have piezoelectric devices which expand or contract when an electric signal is applied to produce the pressure required to eject a droplet or refill the chamber. Unlike the thermal ink jet drop ejector, the expansion and contraction of the chamber volume of a piezoelectric printhead is under continuous electrical control, which allows for controlling the drop volume enabling variable drop-size greyscale printing. For an example of a piezoelectric printhead, refer to U.S. Pat. No. 4,584,590. An acoustic ink jet printhead requires the use of an RF power supply to generate the acoustic energy necessary to eject a droplet. Such an RF power supply is costly and can lead to undesirable RF emissions. The acoustic energy must be tightly focused on the ink surface in order to eject an ink droplet, which leads to very tight tolerances in the design of the printhead, and makes the printhead difficult to manufacture. For an example of an acoustic ink jet printhead refer to U.S. Pat. No. 4,751,530.

Current thermal ink jet printheads require about 5–10 $\mu$J of energy supplied over a 2.7 $\mu$sec time period, and thus 3.5 Watts of power, in order to eject a 20 pL droplet at 10 m/sec. Such a droplet would have 1 nJ of kinetic energy and 0.2 nJ of surface energy, and thus 99.98% of the drop ejection energy goes into waste heat. The thermal inefficiency of thermal ink jet printheads leads to a number of performance limitations; e.g., thermal management becomes a major issue and this problem gets larger as the arrays of nozzles increase. There are also problems with heat management with respect to image quality. As the thermal ink jet printhead heats up, the properties on the ink change (e.g., ink viscosity), leading to changes in the ejected droplet size, thus affecting image quality. Another limitation on thermal ink jet printheads is the restriction to water based inks, because a water vapor bubble is used as the propellant for the ink droplets. Water based inks limit ink latitude which leads to print or image quality limitations, including image permanence, water fastness, smear, and color gamut.

Both piezoelectric ink jet and acoustic ink jet printheads avoid these limitations by using non-thermal means of ejecting droplets. While this leads to increased ink latitude and eliminates heat management problems, there are a number of other problems for each of these techniques. For the piezoelectric ink jet devices, the droplet ejector must be very large, since the piezoelectric actuators provide very little displacement, thus limiting the number of nozzles in an array and thereby affecting print quality and/or productivity. Piezoelectric droplet ejectors are currently fabricated one-by-one, using non-integrated circuit batch fabrication techniques, so that their cost per nozzle is very expensive relative to droplet ejectors fabricated by integrated circuit batch fabrication techniques, such as that used by thermal ink jet devices. Acoustic ink jet printing requires the use of a RF power supply to generate the acoustic energy necessary to eject an ink droplet, and such RF power supplies are expensive. The RF power distribution on the droplet ejector heads is difficult to control. In addition, acoustic ink jet devices use non-standard fabrication processes and materials, with mechanical tolerances on the order of micrometers in all three dimensions which must be uniform over large areas, and thus do not benefit from the economies of silicon or integrated circuit batch fabrication techniques.

An electro-mechanically actuated ink jet printhead is disclosed in the article entitled "An Ink Jet Head Using a Diaphragm Microactuator," by Susumu Hirata et al, Proceedings of the Ninth Annual International Workshop on Micro Electro Mechanical Systems, San Diego, Calif., February 1996, pgs. 418–423. This device uses heat to expand and deform a diaphragm to eject ink droplets. The required energy was 80 $\mu$J and is less energy efficient than thermal ink jet devices which use about 10 $\mu$J.

U.S. Pat. No. 5,402,163 discloses an ink jet printhead which uses an electric current conductive ink and a current conductive bar to create an electro-dynamic force to eject ink droplets. However, this device requires a current conductive ink and thus has limitations on ink latitude, among other disadvantages.

U.S. Pat. No. 4,983,883 discloses an ink jet printhead which uses a magnetic force generating member to act upon a magnetic ink to eject droplets. Since the ink must be magnetic, this requirement imposes serious limitations on ink latitude, among other disadvantages of such a printhead.

U.S. Pat. No. 4,845,517 discloses an ink jet printhead in which a conductive mercury thread is positioned in each ink channel and a magnetic field is applied orthogonally to the channel. A flow of current through the thread causes an electromagnetic deformation of the thread and thereby eject a droplet. An apparent limitation on this concept is the exposure of the ink to the mercury thread which would lead to ink latitude problems.

U.S. Pat. No. 4,620,201; U.S. Pat. No. 4,633,267; and U.S. Pat. No. 4,544,933 disclose a magnetic driver for an ink jet printing device in which many current loops, each with a discharge nozzle, are lying in a common ink chamber. The current loops are moveable under the influence of a magnetic field and act to displace droplets. However, since the current loops act on a common ink chamber, there can be interactions between the different current loops, thus leading to cross talk between droplet ejectors. In addition, since the chamber walls in this design are very distant from the nozzles, and there are low compliance gaps between the nozzles, the mechanical efficiency of the current loops for ejecting liquid droplets is limited.

U.S. Pat. No. 4,455,127 discloses a compact size plunger pump in which pistons are driven to reciprocate by a plunger associated with an electromagnetic solenoid. Since this concept uses an electromagnetic solenoid, it does not lend itself to integrated circuit batch fabrication technology, thus this concept it not economically practical for use in an ink jet printhead environment.

U.S. Pat. No. 4,415,910 discloses an ink jet droplet ejector in which pressurized ink is released on demand by action of an electromagnet operating to unseat a magnetic ball seated on a printhead nozzle. This concept uses a magnetically actuated valve which is not suitable for integrated circuit batch fabrication technology and, thus, this concept is not considered economically practical for use in an ink jet printhead environment.

U.S. Pat. No. 4,057,807 and U.S. Pat. No. 4,032,929 disclose an ink jet printhead comprised of a plurality of ink chambers, each with a nozzle, each chamber has a diaphragm as an outer wall, and an electromagnet which may be selectively energized confronts each diaphragm. When exposed to a magnet field, the diaphragm deforms to decrease the chamber volume and eject a droplet from the nozzles. This concept is not amenable to the silicon integrated circuit batch fabrication technology, so that it is not very cost effective to manufacture, nor is it amenable to the microelectromechanical technology which is so important in a practical, cost effective ink jet printing device.

SUMMARY OF THE INVENTION

It is the object of the present invention to provide a new, cost effective magnetic actuated ink jet printing device which avoids the many problems of the above mentioned thermal ink jet, piezoelectric ink jet and acoustic ink jet printing devices.

In one aspect of the invention, there is provided a magnetically actuated ink jet printing device for use in an ink jet printer, comprising: a substrate having parallel opposing sides and first and second parallel surfaces, the second substrate surface having at least one recess with a bottom surface substantially parallel to the first substrate surface, the recess bottom surface and the first substrate surface being spaced apart by a predetermined distance and defining a diaphragm; at least one electrode formed on the substrate first surface, a portion of the at least one electrode being aligned with and on the at least one diaphragm, the electrode portion overlying the at least one diaphragm being flexible; a patternable member formed on the first substrate surface and having at least one internal cavity opening against the first substrate surface which forms a part thereof, the cavity serving as an ink reservoir and containing the portion of the electrode overlying the diaphragm, cavity having a nozzle and an ink inlet, the nozzle being aligned with the diaphragm; at least one magnetic field generating means being located adjacent the substrate and oriented to generate a magnetic field of a predetermined strength and direction relative to the electrode overlying the diaphragm; an ink supply connected to the ink inlet of the cavity to fill said cavity with ink; and means for selectively applying electrical current pulses to the at least one electrode, the current through the electrode which is in the magnetic field producing a force which causes the diaphragm and electrode to deform momentarily in a direction toward and then away from the nozzle, each of said momentary deformations of the diaphragm and electrode ejecting an ink droplet from the nozzle. To vary the droplet size for greyscale printing, the current direction may be reversed immediately after an initial current to cause the diaphragm to deform in the opposite direction away from the nozzle, thereby increasing the volume of ink contained within the chamber. In another embodiment, a continuous current through the electrode overlying the diaphragm while the electrode is in a magnetic field causes the generation of a force on the diaphragm which keeps the diaphragm deformed towards the nozzle, but ejection of droplets occur when the current is increased and then decreased towards zero current.

BRIEF DESCRIPTION OF THE DRAWINGS

The present invention will now be described by way of example with reference to the accompanying drawings, wherein like reference numerals refer to like elements, and in which:

FIGS. 4–6 show the fabrication process of only one of the plurality of magnetic actuated ink jet printing devices in the wafer of FIG. 2 in cross-sectional view;

FIG. 7 is a schematic cross-sectional view of a magnetic actuated ink jet printing device disclosing the operating principal thereof;

FIG. 10 is a cross-sectional view of another embodiment of the magnetic actuated ink jet printing device similar to the view shown in FIG. 6;

FIG. 13 is a plan view of an alternate embodiment of the electrode covering the diaphragm of the magnetic actuated ink jet printing device which actuates the device and ejects the droplet;

DESCRIPTION OF THE PREFERRED EMBODIMENT

Figure 1:
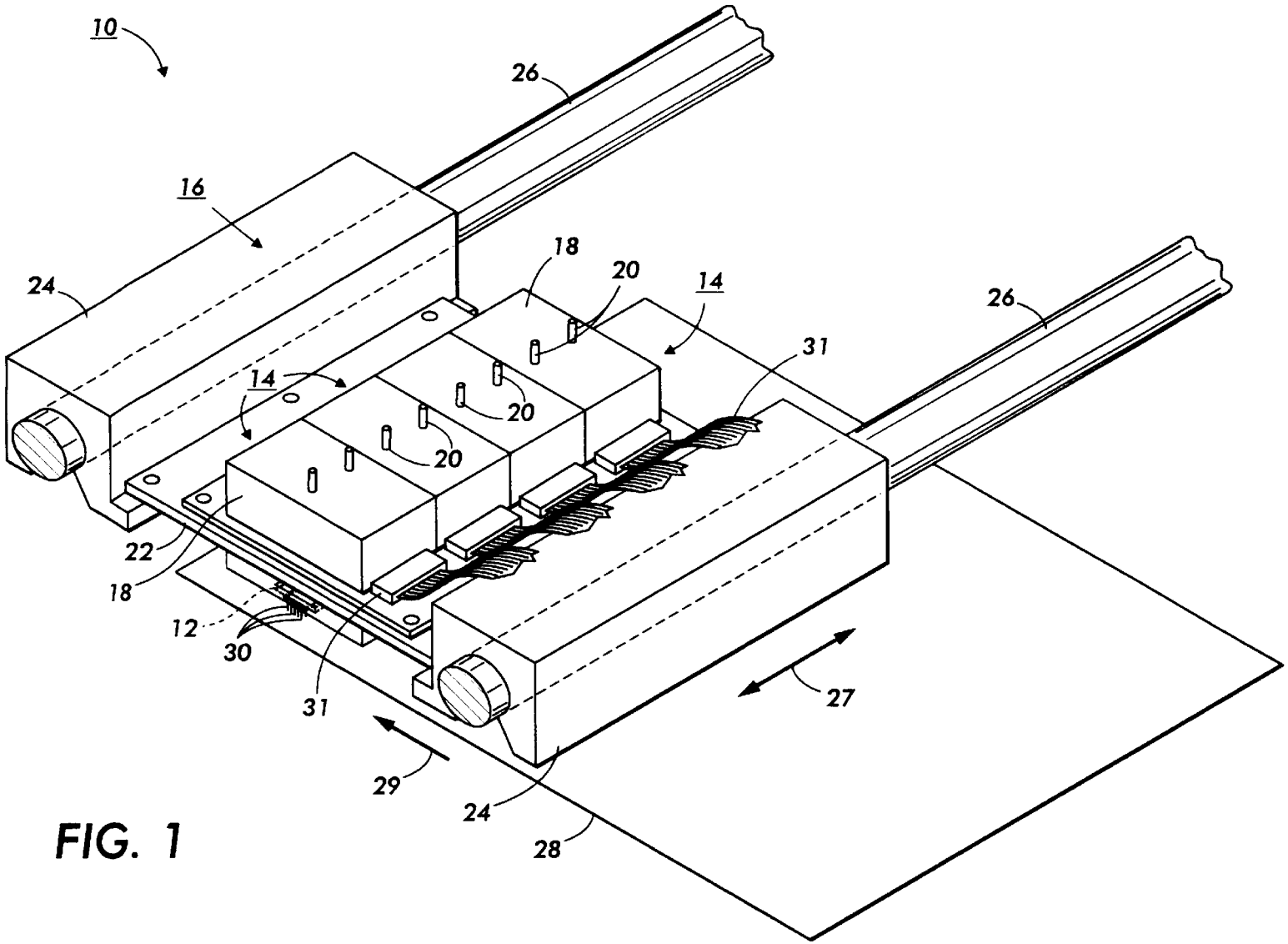
FIG. 1 is a partially shown, schematic, isometric view of a printer having the magnetic actuatuted ink jet printing devices of the present invention.

Referring to FIG. 1, a schematic isometric view of a multicolor ink jet printer 10 is partially shown having the magnetic actuated ink jet printing devices 12 of the present invention shown in dashed line. The multicolor printer comprises four print cartridges 14, one for each color and each with an integral printing device 12, releasably mounted on a translatable carriage 16. The print cartridges have an ink supply manifold 18 and ink inlet connectors 20 for the attachment of ink supply tubes (not shown) which provide means for maintaining the manifolds filled with ink from a main supply (not shown) located elsewhere in the printer. The carriage has a frame 22 on which the cartridges are mounted with slidable guides 24 that travel along guide rails 26 under control of a printer controller (not shown) in the back and forth direction of arrow 27. The printing devices or printheads print swaths of images on a recording medium 28, such as paper, with droplets 30 of ink ejected from the printing device nozzles, not shown in this view. The recording medium is held stationary while each swath of image is being printed and then the recording medium is stepped the distance generally equal to the height of the printed swath of image in a direction orthogonal to the carriage translation direction as depicted by arrow 29. The printing devices eject droplets on demand via ribbon cables 31 from the printer controller. Alternatively, the printhead can be enlarged to cover an entire pagewidth by increasing the number of droplet ejectors. In this implementation the printhead (not shown) can be held stationary while the medium is moved at a constant velocity past it. Such a pagewidth array greatly increases the productivity of the printer.

A conceptual drawing showing the operating principal of the magnetic actuated ink jet printing device 12 of the present invention is depicted in FIG. 7. The printing device 12 comprises a silicon plate 32 having two parallel surfaces 33, 34. The silicon plate is a portion of a (100) silicon wafer having a thickness of about 20 mils or 500 $\mu$m and is anisotropically etched from the surface 34 to provide a recess 36 therein. Alternatively a glass or ceramic laminate (not shown) could be used instead of the silicon wafer and the recess 36 therein provided by an appropriate process, including, for example, by molding or laser ablation. The recess 36 has a bottom surface 37 which is substantially parallel to the silicon plate surface 33 and spaced a predetermined distance therefrom, preferably about 1 $\mu$m, in order to form a relatively thin silicon membrane for use as a diaphragm 38. The surface area of the recess bottom surface and thus the area surface of the diaphragm is predetermined to permit the appropriate deformation, and in the preferred embodiment is about 320 $\mu$m square or, if circular, about 320 $\mu$m in diameter. The silicon plate top surface 33 has an aluminum electrode 40 deposited thereon and aligned so that a portion of the electrode lies over the diaphragm. Alternatively, but not shown, the electrode could be deposited on the silicon plate bottom surface 34 and recess 36 and aligned so that a portion of the electrode lies on the underside of the diaphragm. A nozzle plate 44 is formed on silicon plate surface 33 which has an internal cavity 49 therein. The cavity is open against the silicon plate surface and is aligned with the diaphragm and overlying or underlying electrode. The nozzle plate has a nozzle 46 which is centrally aligned with the diaphragm. The cavity is filled with ink 43 through an inlet (not shown).

First electric current pulses "I" are selectively applied to the electrode 40 via a transistor 42 which may be integrally formed on the silicon plate surface. A predetermined magnetic field B (not shown), which has a field direction extending upward from the surface of the drawing in FIG. 7, causes a force F to be generated whenever a predetermined current passes through the electrode from left to right in FIG. 7, as illustrated by the X,Y,Z coordinates, wherein the force F is the Y direction, the current I is the X direction, and the magnet field B is the Z direction. The generated force F, indicated by arrow 41, deforms the diaphragm in the upward direction towards nozzle 46, as shown in dashed line, thereby increasing the pressure on the ink in the cavity, which serves as an ink reservoir, initiating the ink ejection process. A droplet 30 is ejected from nozzle 46 when, after the diaphragm moves toward the nozzle, the diaphragm moves in direction away from the nozzle, as when current is removed from the electrode. The droplet volume or size may by varied by applying an appropriately timed current pulse in the opposite direction via a second transistor 45 in order to drive the diaphragm in the direction away from the nozzle by an oppositely directed force, thereby immediately increasing the chamber volume rather than decreasing it. Thus, the basic principal on which this invention is based is the well known law of physics that a force is generated when a current is passed through a conductor which lies in a magnetic field.

In an alternate embodiment of the invention, greyscale is achieved by increasing the volume of ink in the printhead cavity 49 for larger ejected droplets. This is accomplished by first placing a current pulse through the electrode in a direction to create a force on the diaphragm which deforms the diaphragm away from the nozzle. Thus, the cavity is momentarily enlarged and then a current pulse in the opposite direction produces a force on the diaphragm which deforms the diaphragm towards the nozzle. As the ink moves through the nozzle, the current is removed or its direction reversed to enable the diaphragm to return to its original position or be driven back.

The required pumping pressure at the nozzle 46 is given by the following formula:

$$P=P_{viscous}+P_{surface\ tension}+P_{dynamic\ pressure}=32\,\mu Lu/A(\tau)d^2+4\gamma/d+(½)\rho u^2$$

where: $\mu/\rho$=kinetic viscosity (0.018 $cm^2$/sec for $H_2O$); L=nozzle channel length; A($\tau$)=transient flow coefficient; u=droplet velocity=10 m/sec; d=nozzle diameter; $\gamma$=surface energy=60 mJ/$m^2$ for $H_2O$; and p=density (mass per unit volume)=1 gm/$cm^3$ for $H_2O$ so that P=1.0 atmospheres (atm)+0.1 atm+0.5 atm=1.6 atm for a water droplet ejected out of a nozzle channel length L=100 $\mu$m and a nozzle diameter d=30 $\mu$m. Thus, the required force F to eject a water droplet is the pumping pressure P divided by the nozzle area, or $F=(1.6\ atm)\times[\pi(d/2)^2]=(1.6\times10^5\ n/m^2)\times[3.14\times(1\times10^{-10}\ m^2)]=50\times10^{-6}$ N. The force available from the diaphragm of the magnetic actuated ink jet printing device can be calculated from the Lorenz force equation for the force acting on a charge carrying particle moving in the presence of a magnetic field: F=qv×B=ILB; where q=charge on the particle; v=velocity of the particle; B=magnetic field; I=current (charge per unit time); and L=length of electrode, so that for I=400 mA in a B=0.8 Tesla field, the force F per unit length would be $4.0\times10^{-1}$ N/m. For $F=50\times10^{-6}$ N, the length of the electrode is a minimum of 125 $\mu$m long.

Figure 2:
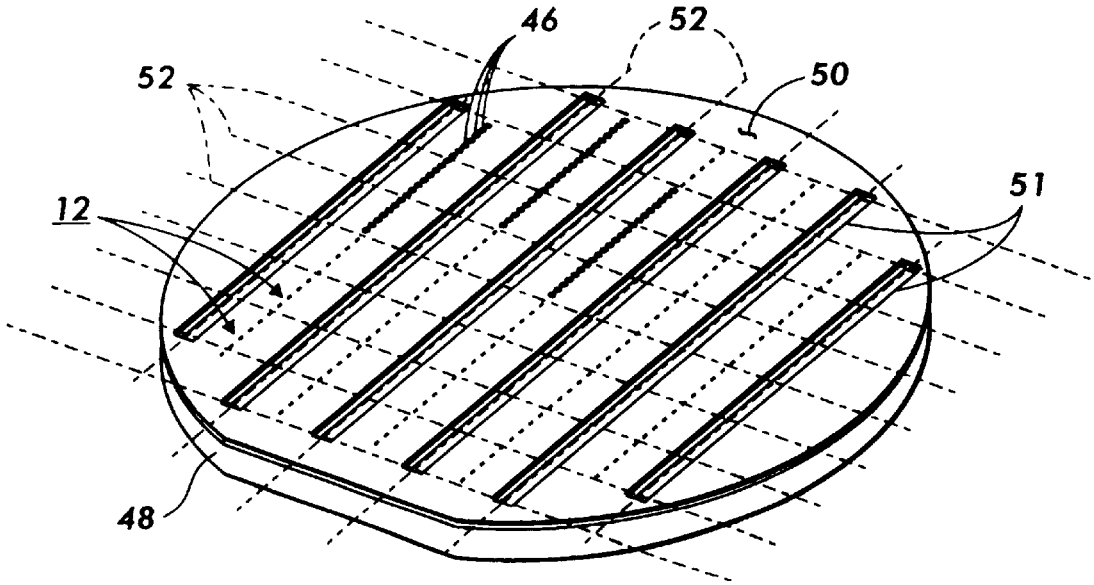
FIG. 2 is an isometric view of a silicon wafer containing on the surface thereof a plurality of the magnetic actuated ink jet printing devices of FIG. 1, and showing the dicing lines for separating the devices.

In one embodiment, the printing devices 12 are fabricated using a silicon integrated circuit batch fabrication technique. As shown in FIG. 2, a plurality of magnetic actuated ink jet printing devices or printheads 12 are shown prior to separation into a plurality of individual printing devices. Alternatively, full width array printing devices can be fabricated on large substrates, such as, glass or ceramic composites. In this embodiment, the printing devices are fabricated from a (100) silicon wafer 48 and a layer 50 of photopatternable material, such as, for example, polyimide. The layer of photopatternable material is patterned to form elongated trenches 51 which expose the contact terminals for the electrodes (see FIG. 3). Each of the printing devices 12 have an array of nozzles 46 and mutually perpendicular dicing cut lines 52, shown in dashed lines, which will be subsequently used to separate the printing devices.

Figure 3:
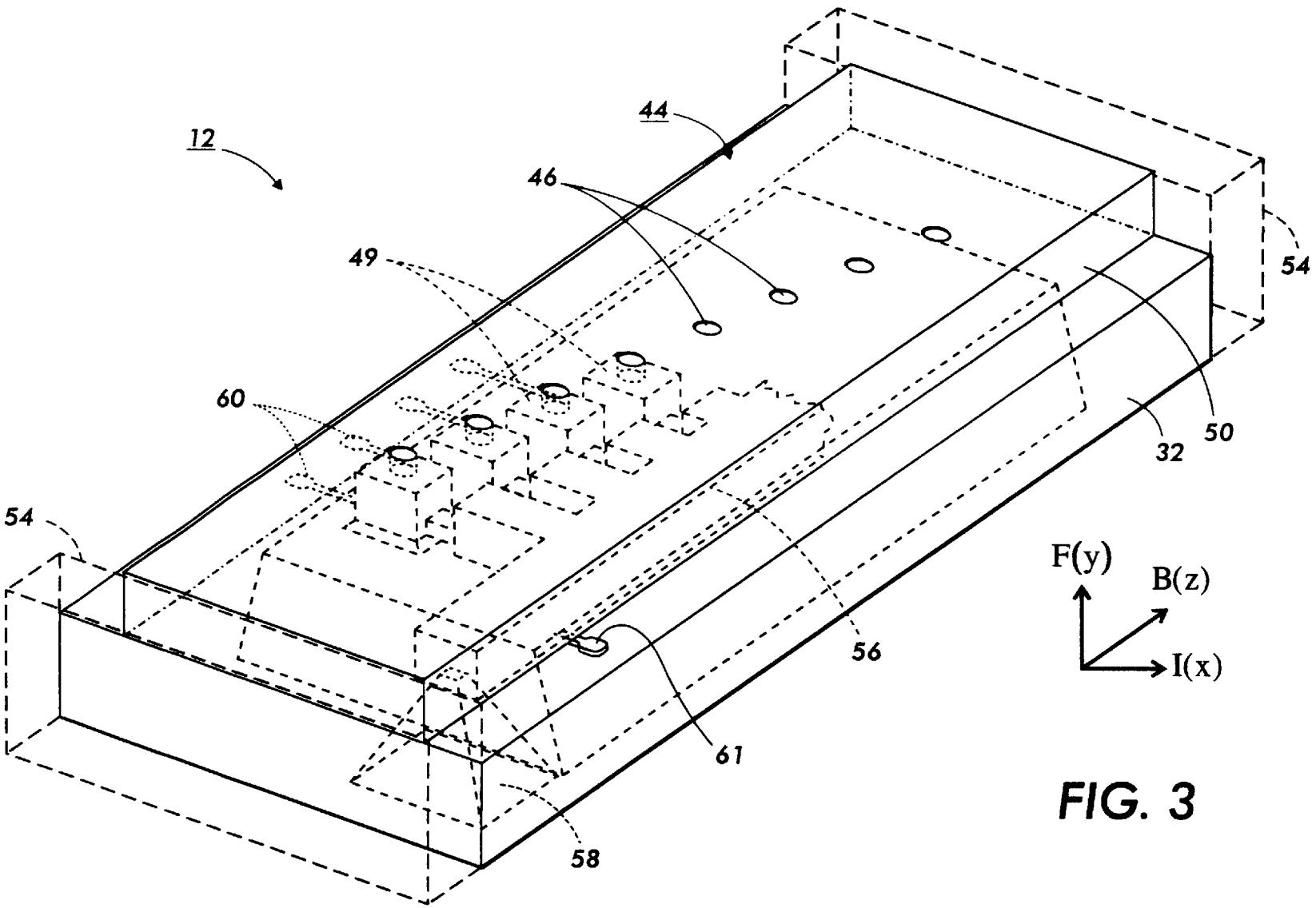
FIG. 3 is a single magnetic actuated ink jet printing device shown in isometric view after separation from the wafer in FIG. 2.

A single printing device 12 is shown in isometric view in FIG. 3 with two magnetic field generating means (shown in dashed lines), such as, for example, two magnets 54 of sufficient magnetic flux density or field strength on opposing sides thereof. Rare earth magnets, such as cobalt samarium magnets, each having a magnetic field strength of 0.82 Tesla or 8,200 Gauss and located on opposite sides of the printing device with an orientation such that their fields are additive, are sufficient for generating the required droplet ejecting force F for a 600 spi pitch of 42 $\mu$m when electric current pulses of 250 mA are applied to the electrodes on the diaphragm 38 (see FIG. 7). The printing device comprises a portion of a silicon wafer referred to as a silicon plate 32, electrodes 40 covering a diaphragm for each nozzle 46, and a patterned layer 50 of photopatternable material, referred to as nozzle plate 44. The cavities 49, which serve as ink reservoirs for each nozzle, and a common ink manifold 56 connecting the cavities with inlet 58 are provided by a through etch in the silicon plate and are shown in dashed line. The electrode contact terminals 60,61 for input and common return, respectively, are shown exposed by the patterning of the nozzle plate. To clarify the orientation of the printing device relative to magnetic field and current direction, a coordinate system is provided showing the X,Y,Z coordinates as the current I, the force generated direction F, and magnetic field B, respectively.

Figure 4:
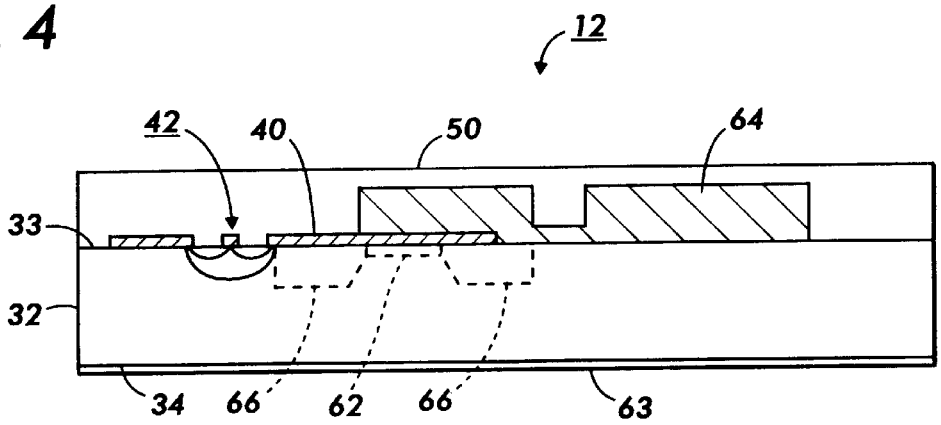
Figure 5:
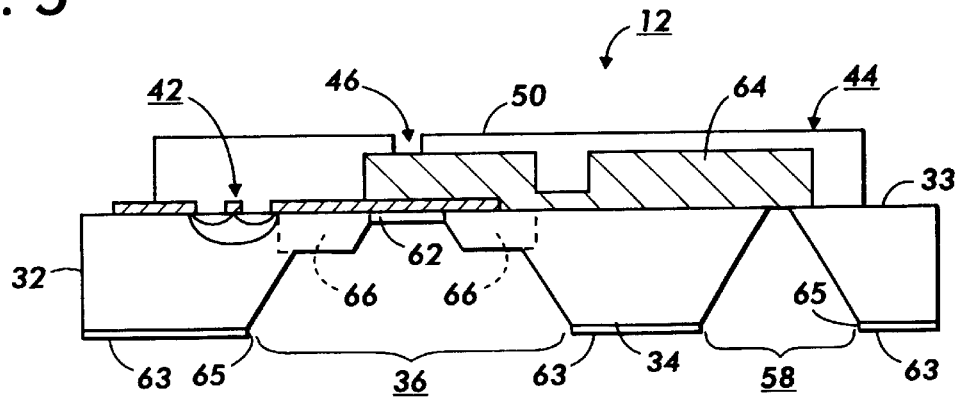

FIGS. 4–6 show the integrated circuit batch fabrication process for the magnetic actuated ink jet printing devices 12. Although the fabrication process is on the wafer scale, the portion of the wafer 48 (see FIG. 2) depicted is a cross-sectional view of only one printing device for ease of explanation. In FIG. 4, the portion of a n-type (100) silicon wafer, hereinafter referred to as the silicon plate 32, has a thickness of about 20 mils (500 $\mu$m) and one surface 33 is doped through one or more masks to form a patterned p-type etch stop 62 for each printing device nozzle having a surface dimension of 320 $\mu$m×320 $\mu$m or 320 $\mu$m in diameter and a concentration of about $10^{19}$ Boron ions/cc to a depth of about lam. Alternatively, an electrochemical etch stop, which is well known in the industry, can be used with a much smaller concentration of dopant ions in order to avoid the high stress that is generated in the membrane or diaphragm by a high concentration of Boron ions. See for example, T. N. Jackson, M. A. Tischler, K. D. Wise, IEEE Electron Device Letters, Vol. EDL-2, No. 2, February 1981. Each of these etch stops 62 will subsequently define the flexible diaphragms 38 (see FIGS. 6 and 7) which will be used to eject ink droplets. A second area 66 encompassing and surrounding all of the diaphragm etch stops 62 is also p-doped to the same concentration, but to a larger depth, namely, 18 $\mu$m. For an eight nozzle printing device, second p-doped area 66 would have a surface area of about 2700 $\mu$m×650 $\mu$m. The opposite surface 34 or optionally each of the surfaces 33, 34 of the silicon plate is protected by a protective, etch resistant layer 63, such as, for example, silicon nitride or silicon oxide, having a thickness of about 1000 angstrom to 1 $\mu$m. The etch resistant layer 69 on surface 33 of the silicon plate is shown only in the embodiment disclosed in FIG. 14. Optionally, an integral semiconductor transistor or CMOS switch 42 could be formed on the surface 33 of the silicon plate during this stage of the process for use as the switch to selectively apply an electric current to a subsequently formed electrode. Metal electrodes 40, such as aluminum, is patterned on the silicon plate surface 33 so that each electrode overlies an etch stop 62 and is oriented so that current must flow in a particular direction. In FIG. 4, the current flow direction is either left to right or right to left. As at least a portion of each electrode 40 will be exposed to ink, the electrode is passivated with a passivation layer (not shown), except for the electrode ends used as contact terminals 60,61(also see FIG. 9).

Next, a 20 to 30 $\mu$m thick sacrificial layer 64 is deposited and patterned on the surface 33 of the silicon plate and the passivated electrodes 40 thereon. A low temperature process is required for the deposition of the sacrificial layer, so that the underlying metal electrodes are not attacked. Several suitable photoresists, such as, for example, AZ4620™ a commercially available photoresist from Shipley, may be sputtered or spun on to the appropriate depth at a temperature of less than 400° C. which process temperature will not attack the metal electrodes. The other requirement of the sacrificial layer is that it must be selectively removed by chemicals which will not attack the nozzle plate material, which in the preferred embodiment is polyimide. This sacificial layer is then patterned to build the areas for the ink cavity 49 (see FIGS. 6 and 7) and ink flow passages such as the common manifold 56 (see FIG. 6) and passageways which interconnect the ink cavities 49 to the manifold. The next step is the deposition of one or more layers of a material, such as, for example, a photosensitive polyimide layer 50 to a thickness of about two times that of the sacrificial layer or about 40 to 60 $\mu$m which will later be patterned using typical photolithographic steps to form the nozzle plate 44. If necessary, an etch resistant layer (not shown) may be deposited over layer 50 to protect it from a subsequent anisotropic etch.

Referring to FIG. 5, the protective, etch resistant layer 63 on the back side surface 34 of the silicon plate is patterned to provide vias 65 therein and an anisotropic etchant is used, such as potassium hydroxide (KOH) or ethylenediamine pyrocatechol (EDP), to etch the recess 36 and through hole 58 with open bottom 59. The etch stops 62, 66 prevent further etching. The etch stop 62 provides the diaphragms 38. The through hole 58 will subsequently serve as an ink inlet to the common manifold provided by removal of the sacrificial layer. The next step is to pattern the layer 50 to form the nozzles 46 and nozzle plate 44 and to remove the layer from above the electrode terminals 60, 61 for access thereto. When a photosensitive polyimide is used for the layer 50, the patterning is done photolithographically by means well known in the industry. In the final step, the sacrificial layer 64 is removed using selective wet etch followed by curing the patterned layer 50 if necessary, to form the nozzle plate 44 as shown in FIG. 6. On a wafer scale process, a plurality of printing devices would be integrally formed on a four or five inch diameter silicon wafer and the wafer would be diced along the dicing lines 52 (see FIG. 2) to separate the printing devices into a plurality of individual printing devices. Each individual printing device 12 is then bonded to an ink supply manifold 18, shown in FIG. 6 in dashed line, with a manifold opening 67 in alignment with the etched through hole 58, so that ink in the ink supply manifold is in fluid communication with the nozzles 46 in the nozzle plate 44 by way of a flow path through the common manifold 56 and thus to the cavities or ink reservoirs 49 which connect to the nozzles (see also FIG. 3). For a pagewidth printing device (not shown), printing devices 12 could be abutted or staggered for the desire length, or as mentioned above the diaphragm bearing substrate 32 and nozzle plate 44 could be pagewidth in length with the magnetic field generating means 54 spaced along the length of the printing device.

Figure 8:
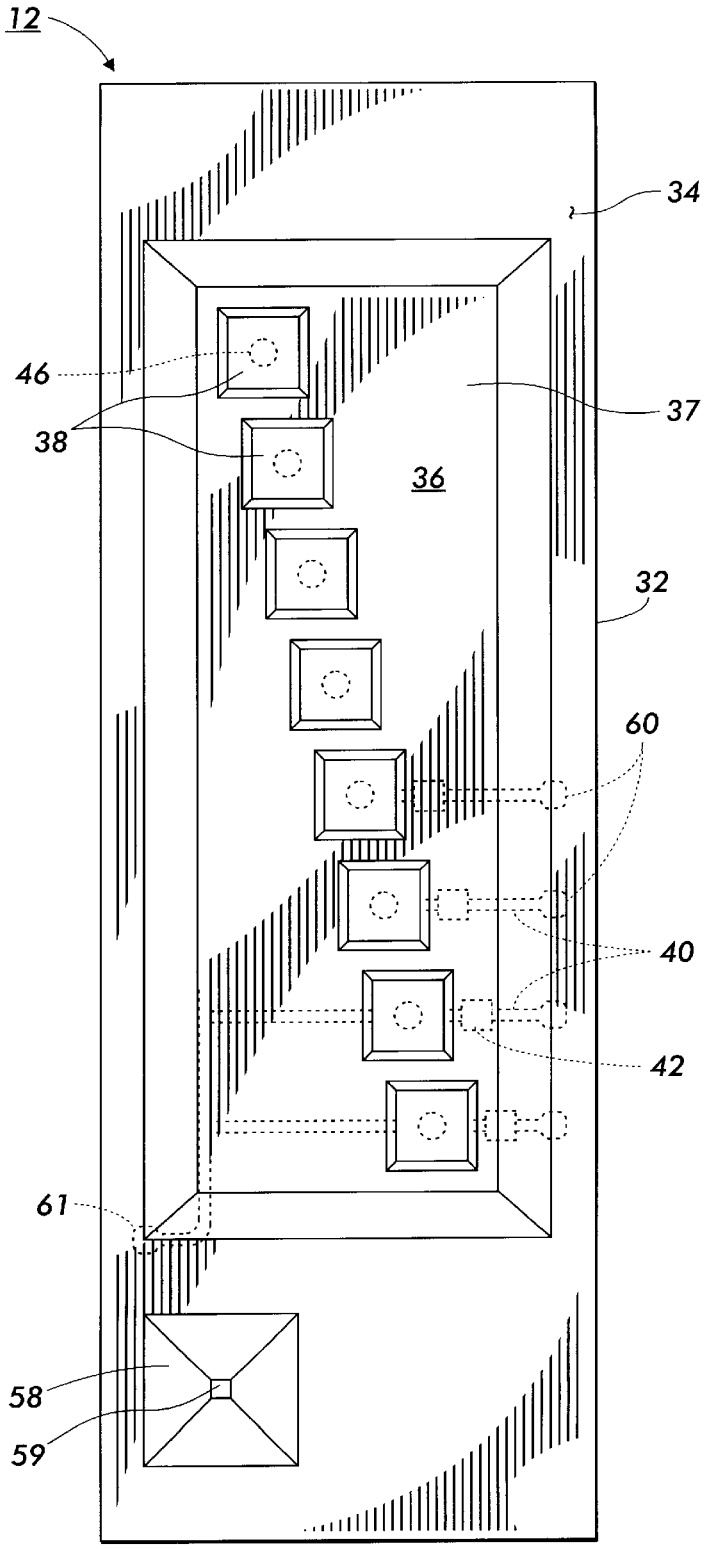
FIG. 8 is a bottom view of a magnetic actuated ink jet printing device.

In FIG. 8, a bottom view of the magnetic actuated ink jet printing device 12 is shown. This printing device has been fabricated in accordance with the fabricating process discussed above and as depicted in FIGS. 4–6. Although only eight diaphragms 38 are shown in the silicon plate 32 for clarity, an actual printing device would have many more in an array on a 600 spi spacing. In this view, the main anisotropically etched recess 36 through silicon plate surface 34 is shown which has a depth defined by the etch stop 66, so that the recess bottom surface 37 is formed at the 18 $\mu$m deep etch stop 66. All of the diaphragms 38 are defined by the etch stops 62, each having the depth of 1 $\mu$m, so that the diaphragms are 1 $\mu$m thick. There is one diaphragm for each nozzle 46, the nozzles being shown in dashed line. For assistance in understanding the invention, a few of the addressing electrodes 40, integral transistors 42, and input terminals 60 are shown in dashed line. Also shown in dashed line is the common return terminal 61. Located at one end of the silicon plate is the etched through recess 58 and open bottom 59 which serves as the inlet to the common manifold 56 of the nozzle plate 44 (see FIG. 3).

Figure 9:
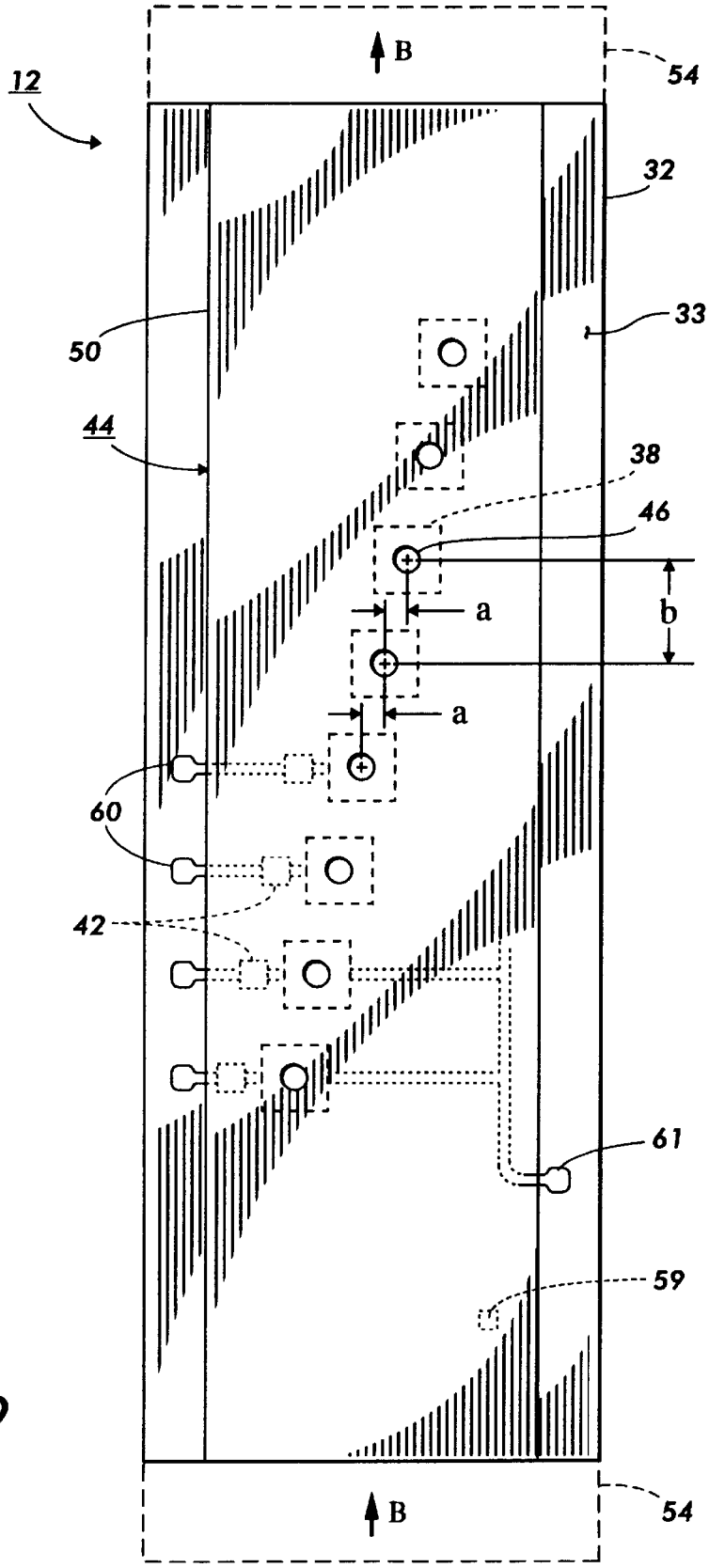
FIG. 9 is a top view of a magnetic actuated ink jet printing device.

A top view of the magnetic actuated ink jet printing device 12 is shown in FIG. 9. The nozzles 46 are spaced along a column by the center-to-center distance 'b' and off set from each other by the dimension 'a', so that the array is slightly inclined. The 'b' distance is about 320 $\mu$m and the 'a' dimension is about 42 $\mu$m. The diaphragms 38 are shown in dashed line below each nozzle. The layer 50 of nozzle plate material, such as polyimide, has been patterned to expose the terminals 60, 61 on the surface 33 of the silicon plate 32 and to form the nozzles 46 is the nozzle plate 44. The etched ink inlet 59 is also shown in dashed line for clarity. The magnetic field generating means 54, such as for example, permanent magnets are shown in dashed line with the orientation of the magnetic field B indicated by arrows. The magnetic field orientation may be any planar direction, so long as the electrode portions adjacent the diaphragms are within the magnetic field and are perpendicular to the magnetic field direction.

An alternate embodiment is shown in FIG. 10, which is similar to the cross-sectional view of FIG. 6. The difference between the two embodiments is that in FIG. 10, the etched through recess 58 with open bottom 59 is omitted and instead the sacrificial layer is patterned to open through the side of the layer 50 of nozzle plate material when it is patterned. When the sacrificial layer is removed, an open passageway 68 penetrates the side 57 of the nozzle plate 44. A hose connection 70 is bonded to the nozzle plate and a hose 72 is connected thereto. The fabrication process of FIGS. 4 to 6 are otherwise identical; viz., the surface 33 of the silicon plate 32 is doped to form the etch stops 62, 66 to a concentration of $10^{19}$ Boron ions/cc to the respective depths of 1 $\mu$m and 18 $\mu$m. The etch resistant protective layer 63 of silicon nitride or silicon oxide is deposited on the bottom surface 34 of the silicon plate. The integral transistor or semiconductive switch 42 may optionally be produced at this time in the top surface 33 of the silicon plate, followed by patterning the metal electrodes 40 and the deposition of the sacrificial layer 64 (see FIG. 5). Next, the relatively thick layer of nozzle plate material is deposited over surface 33 of the silicon plate including the sacrificial layer 64, followed by the patterning of the protective layer 63 to produce vias 65 for anisotropic etching of the recess 36 which provide the diaphragms 38. The final step is the patterning of the layer 50 of nozzle plate material to expose the electrode terminals 60,61 and produce the nozzles 46.

Figure 11:
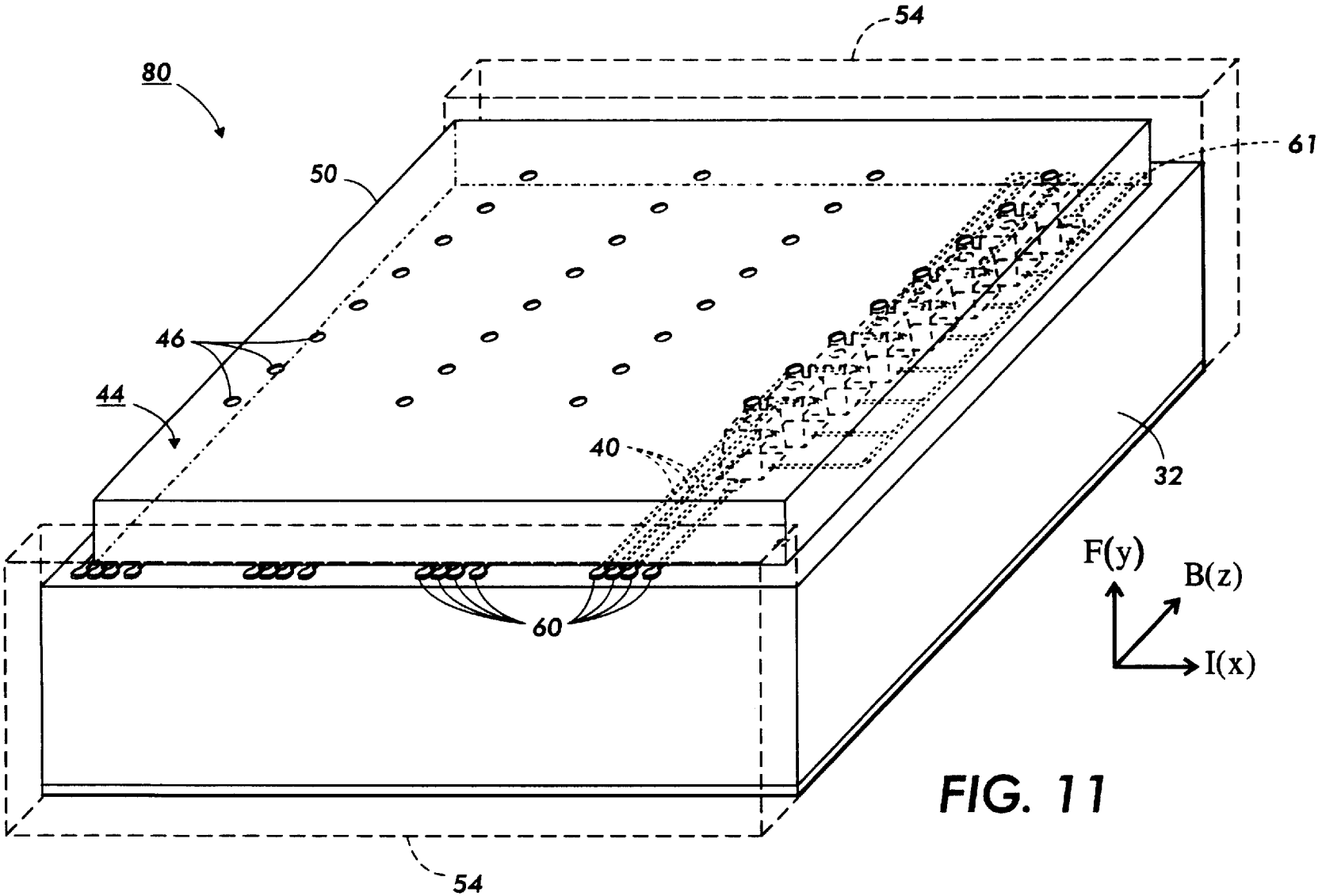
FIG. 11 is an isometric view of a multicolor magnetic actuated ink jet printing device, wherein four arrays of nozzles are fabricated in a single printing device.

The multicolor printer of FIG. 1 has four printing devices of FIG. 3, one for each color of yellow, cyan, magenta, and black. FIG. 11 shows an isometric view of a multicolor printing device 80, which differs from that of the single array of nozzles in the printing device of FIG. 3, only in that the four arrays of nozzles are on a single plate 32, so that alignment of the nozzles for each color is eliminated. The size of the plate is larger to accommodate the increased number of electrodes 40 and electrode terminals 60, 61 and increased number of nozzles and the plate may be any suitable material such as ceramic or glass, but is preferably silicon. The nozzle plate material 50 is patterned to provide the nozzle plate 44 and the four arrays of nozzles 46 and to expose all of the electrode terminals. The magnetic field generating means 54 are shown in dashed line and a X,Y,Z coordinate system is shown to depict the orientation of the magnetic fields, the current direction in the electrodes over the diaphragms, and the resultant force F produced which deforms the diaphragms towards and then away from the nozzles to eject the ink droplets.

Figure 12:
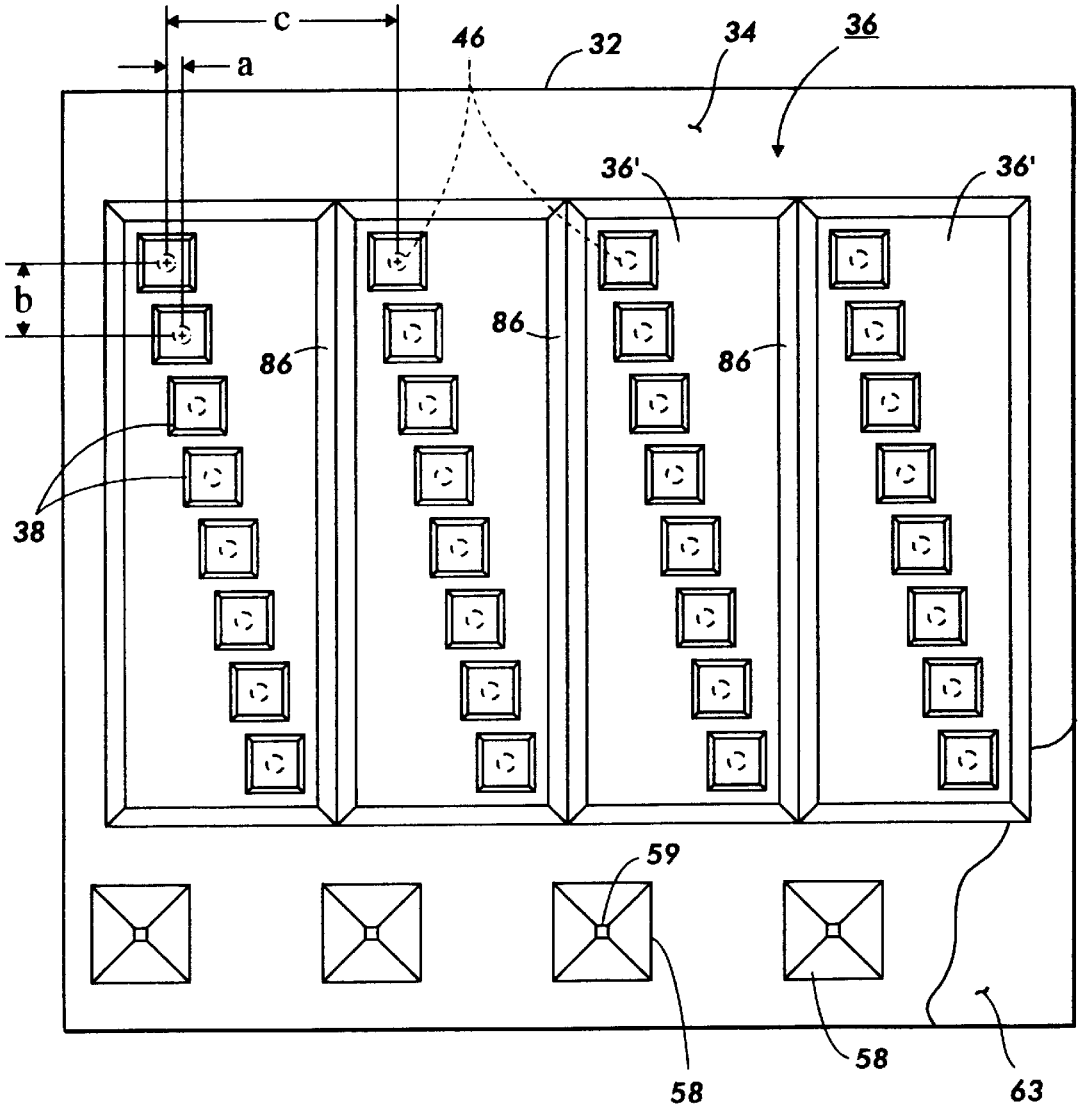
FIG. 12 is a bottom view of the magnetic actuated ink jet printing device of FIG. 11.

A bottom view of the multicolor printing device of FIG. 11 is shown in FIG. 12. In this view, four arrays of eight diaphragms each are shown with each diaphragm 38 having a nozzle 46 shown in dashed line. The nozzles have center-to-center spacings 'b' and 'c', where 'b' is about 320 $\mu$m and 'c' is about 640 $\mu$m. The off-set of the nozzles in each column is depicted by the dimension 'a' which is the same as that of the single array of nozzles in the printing device of FIG. 3, viz., about 42 $\mu$m. Thus, the etched recess 36 which is etched to the doped etch stop 66 contains in the floor 37 thereof, the arrays of etched recesses which are further etched to the etch stops 62 that define the thickness of the diaphragms 38. The etch stop 66 is 18 $\mu$m deep and the etch stop 62 is 1 $\mu$m deep, respectively, from the top surface 33 of the silicon plate 32, so that the main recess floor 37 is spaced from the top surface of the silicon plate by the thickness of the etch stop 66 and the floor of the recesses which define the diaphragms 38 are spaced from the top surface of the silicon plate by the thickness of the etch stop 62. Reinforcing ribs 86 may optionally be provided in the recess 36 by using a separate via (not shown) in the etch resistant layer 63 for each array of diaphragms 38, so that each array of diaphragms have a separate recess 36.

An alternate embodiment of the electrode which lies on the top or bottom of each diaphragm is shown in FIG. 13. The electrode is two separate coils 82, 84 of wire patterned over the diaphragm 38, so that each of the wires pass over the diaphragm several times and a current pulse through the coils of wire pass the current in the same direction. Such configuration of wire coils is often referred to as a "voice coil". For the above described embodiments where the nozzles have a center-to-center distance or pitch of 42 $\mu$m, and using 2 $\mu$m wires with 2 $\mu$m spacing, the same wire passes over the diaphragm ten times per pitch and the current in the wires over the diaphragm 38 pass in the same direction as indicated by an arrow representing current direction. Therefore, the current load through the coiled wire is reduced to about 50 mA. This current level is below the typical drive currents of 80 mA used for thermal ink jet printheads, so that current can be switched with transistors in the NMOS technology.

When using two magnets arranged so that their magnetic fields are additive, thereby doubling the field strength, as is shown in the above embodiments, the current requirement is reduced by a factor of two. The current requirement can be further reduced by an additional factor of two by overlaying a second layer of windings (not shown) in a second layer of metallization (such as typically used in a CMOS process). Such an arrangement doubles the number of wire windings in each pitch from 10 as shown in FIG. 13 to 20 wire crossings on the diaphragm, thus reducing the current requirement by an additional factor of two. By doubling the wire crossings, the required current to eject a droplet can be decreased to 12.5 mA. Alternatively, the current in such an arrangement can be maintained at 50 mA, so that the force developed thereby is increased by a factor of four. The increase in force by a factor of four will lead to an increase the deformation of the diaphragm by a factor of four. Such an increase in diaphragm deformation may be desirable to compensate for any low compliance in the walls that form the chamber volume which could lead to a decrease in the ejected drop volume.

In the preferred embodiment, a sheet electrode is used for simpler layout and processing. The force F per unit area on a current sheet electrode is given by the formula $F/A=\xi B$; where B is the magnetic field in Tesla (T) and $\xi$ is the sheet current density in amps/m$^2$. At a field strength of 0.8 T, with a current of 500 mA flowing through the sheet electrode that is 120 $\mu$m wide, $\xi=4.2\times10^3$ amps/m$^2$, and the force per unit area is $3.33\times10^3$ N/m$^2$. To generate the required 50 $\mu$N of force to eject a droplet, the diaphragm would require an area of $1.5\times10^{-8}$ m$^2$. This is an area of about 120 $\mu$m×120 $\mu$m which when off set by 42 $\mu$m easily provides a nozzle spacing of 600 spi. The power dissipation in the magnetic actuated diaphragm can be determined from the formula $P=I^2R$, where I is the current and R is the resistance of the current carrying sheet. The resistance for an aluminum sheet that is about 0.5 $\mu$m thick is approximately 56 m$\Omega$. For a 500 mA current pulse, the power dissipation is $P=I^2R=(0.5\text{ amps})^2(56\times10^{-3}\ \Omega)=14$ mW. Therefore, a 60 $\mu$sec current pulse would dissipate about 0.84 $\mu$J. This is much less power and energy required to eject a droplet than required by thermal ink jet printheads, which require on the order of 3 Watts and 10 $\mu$J of power and energy, respectively.

The central displacement w of a square diaphragm with L meters per side clamped along the edges and having a thickness of h meters is given by the formula:

$$w=(1.638\times10^{-3})12(1-v^2)/E(L^4/h^3)P$$

Where E is Young's modulus for polyimide (5 GPa), v is the Poisson ratio for polyimide (0.35), and P is the applied pressure of 50 $\mu$N/(120 $\mu$m)$^2$=$3.5\times10^3$ Pa. Therefore, w=0.3 $\mu$m. For silicon, Young's modulus is 165 GPa and the Poisson ratio is 0.28. For silicon nitride, Young's modulus is 270 GPa and the Poisson ratio is 0.27.

In order to displace a 2 pL droplet, using a 120 $\mu$m×120 $\mu$m diaphragm, the required displacement is 0.14 $\mu$m, assuming that the ratio of droplet volume/change in chamber volume equals 1. The size of the diaphragm can be increased as necessary to compensate for any losses in ejected droplet volume due to compliance within the ejection chamber. A small change in the size of the diaphragm leads to a large change in the displacement of the diaphragm since the displacement varies as the fourth power of the size. The ejected droplet volume can also be modulated for gray scale by variation of the magnitude or shape of the current pulse, to provide a larger or smaller diaphragm pressure P, and thus a larger or smaller diaphragm displacement w. Droplet modulation can also be obtained as explained earlier by varying the sign of the current pulse, in order to deflect the diaphragm away from the nozzle in order to increase the chamber volume.

Figure 14:
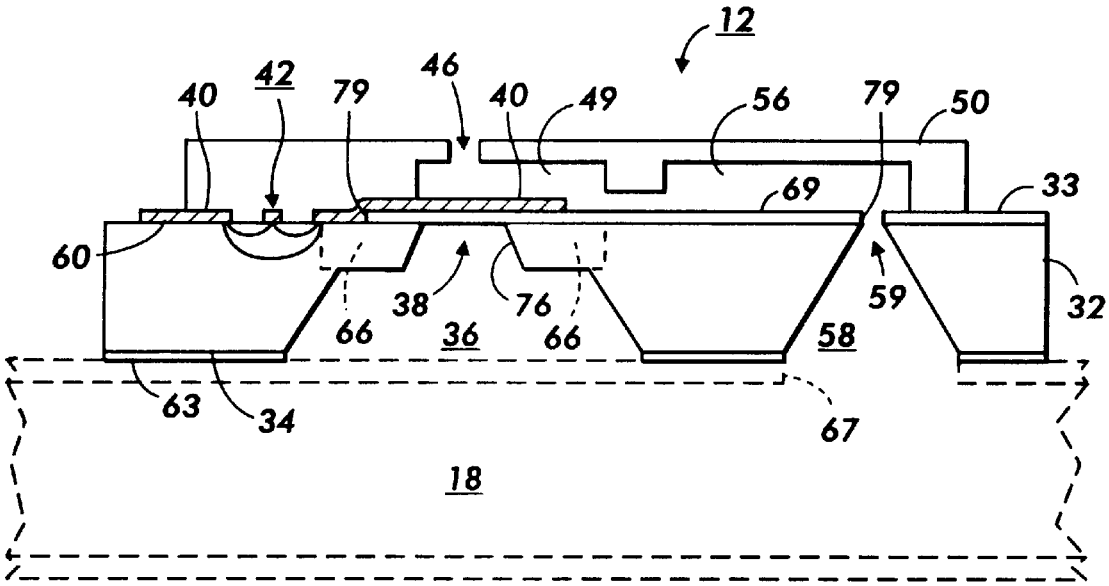
FIG. 14 is a cross-sectional view of an alternate embodiment of the magnetic actuated ink jet printing device and is similar to the cross-sectional view of FIG. 6.

Another embodiment of the magnetic actuated printing device 12 is shown in FIG. 14. This embodiment is similar to the embodiment shown in FIG. 6, but differs in that the patterned etch stops 62 are omitted, and an etch resistant layer 69 such as silicon nitride, is deposited on the top surface 33 of the silicon plate 32. The etch resistant layer 69 is patterned to provide vias 79 to expose the top surface 33 in areas to be subsequently used for the integral transistors 42 and transistors 45, if used, and the ink inlet 59. The metal electrode 40 is formed on the etch resistant layer 69 and exposed silicon plate surface 33. The electrode is passivated by, for example, a second etch resistant layer of silicon nitride (not shown) thereby sandwiching the electrode between electrically insulating layers. Without etch stop 62, the anisotropic etching of the recess 36 enables the etching of a second recess 76. The second recess 76 is etched completely through the areas no longer protected by the patterned etch stops 62, so that the diaphragms 38 are provided by the exposed etch resistant layers 69. Alternatively, the etch resistant layer may be removed and replaced with a layer of polyimide or other suitable material for the diaphragm.

Figure 15:
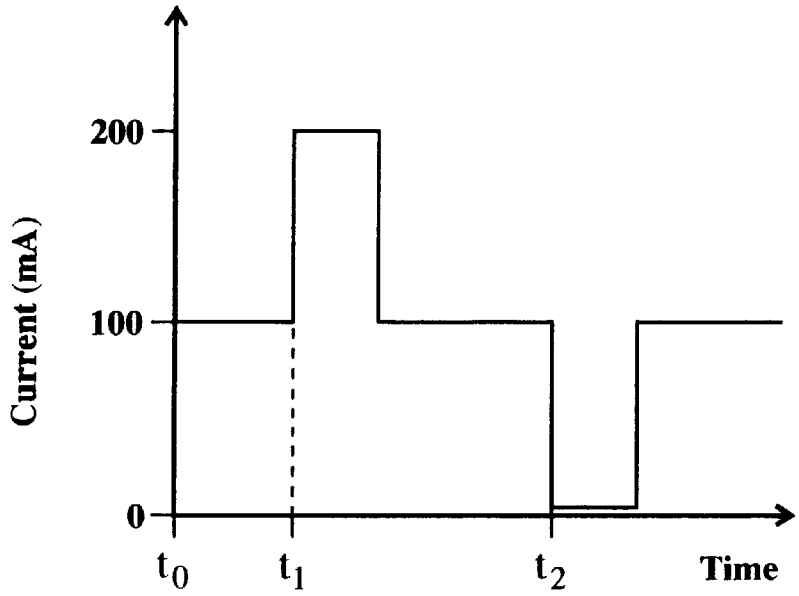
FIG. 15 is a waveform of the current through the electrode on the diaphragm in one embodiment of the magnetic actuated ink jet printing device, showing a continuous current which is increased and decreased to eject an ink droplet.

An alternate embodiment of a current waveform is shown in FIG. 15 in which the current is continuous during the printing mode for the magnetic actuated ink jet printing device. In this embodiment, the diaphragms are always deformed towards the nozzles as shown in dashed line in FIG. 7 by a continuous current of 100 mA, but droplet ejection takes place only when the current is momentarily increased to, for example, 200 mA increasing the generated force and moving the diaphragm further towards the nozzle and then reduced to, for example, substantially zero, so that each of the diaphragms instantly move in a direction away from the nozzle. Therefore, the ink containing cavities or reservoirs having respective nozzles have their pressure selectively increased then decreased to expel an ink droplet of predetermined volume. The relative timing of increase and decrease of the current provides the modulation of the droplet volume and thus grey scale printing. Though the waveform is shown as simple square wave pulses for ease of explaining this embodiment of the invention, a more complex wave form is used in order to control the droplet ejection process.

Although the foregoing description illustrates the preferred embodiment, other variations are possible and all such variations as will be obvious to one skilled in the art are intended to be included within the scope of this invention as defined by the following claims.

We claim:

1. A magnetically actuated ink jet printing device for use in an ink jet printer, comprising:

a substrate having parallel opposing sides and first and second parallel surfaces, the second substrate surface having at least one recess with a bottom surface substantially parallel to the first substrate surface, the recess bottom surface containing at least one flexible membrane therein, defining a diaphragm;

at least one electrode formed on the substrate, a portion of the at least one electrode overlying and being affixed to the at least one diaphragm, the electrode portion overly the at least one diaphragm being flexible;

a member formed on the first substrate surface and having at least one internal cavity opening against the first substrate surface which forms a part thereof, the cavity serving as an ink reservoir, said cavity having a nozzle and an ink inlet, the nozzle being aligned with the diaphragm;

at least one magnetic field generating means being located adjacent the substrate and oriented to generate a magnetic field of a predetermined strength and direction relative to the electrode over the diaphragm;

an ink supply connected to the ink inlet of the cavity to fill said cavity with ink; and means for selectively applying electrical current to the at least one electrode, the current through the electrode which is in the magnetic field producing a force which causes the diaphragm with the electrode to deform momentarily in a direction at least one of toward and away from the nozzle, each momentary deformation of the diaphragm and electrode ejecting an ink droplet from the nozzle.

2. The printing device as claimed in claim 1, wherein the recess bottom surface has at least one second recess therein, the second recess has said membrane for a bottom surface; and wherein said member is photopatternable.

3. The printing device as claimed in claim 2, wherein the substrate is silicon; wherein the photopatternalbe member is photosensitive polyimide; and wherein at least one magnetic field generating means is a pair of permanent magnets located on opposing sides of the printing device with a like orientation, so that the magnetic fields generated thereby are additive.

4. The printing device as claimed in claim 1, wherein the current to the at least one electrode is applied through one or more transistors; and wherein said transistors are integrally formed on one of the substrate surfaces.

5. The printing device as claimed in claim 1, wherein said means for applying electrical current provides current pulse in a first direction through the electrodes followed by a current pulse in a second opposing direction, the first and second direction of the current each producing a force on the diaphragm in opposite directions to control the ejected droplet volume.

6. The printing device as claimed in claim 1, wherein the means for applying electrical current provides a continuous current of a predetermined value when the printing device is in the printing mode and a droplet is ejected from the member nozzle by first increasing momentarily the continuous current value followed by a decrease in the current value below said continuous current value.

7. The printing device as claimed in claim 1, wherein the at least one electrode has two separate coils of wire patterned on the diaphragm so that each of the wires pass over the diaphragm several times and each portion of the coils on the diaphragm passes current in the same direction.

8. The printing device as claimed in claim 1, wherein the ink inlet to the member cavity is located in the substrate.

9. The printing device as claimed in claim 1, wherein the ink inlet to the member cavity is located in the member.

10. The printing device as claimed in claim 1, wherein the substrate has four arrays of flexible membranes, each of which serve as diaphragms; wherein each diaphragm has an individually addressable electrode having a portion thereof overlying and affixed to the diaphragm; the member having an internal cavity for each diaphragm, the internal cavities for each array of diaphragms being interconnected with a common manifold and each common manifold having an ink inlet which is connected to a separate one of four ink supplies, the ink supplies each having a different color of ink.

11. The printing device as claimed in claim 1, wherein the means for selectively applying electrical current to the at least one electrode, applies a current which causes the diaphragm with the electrode to deform momentarily in a direction toward and then away from the nozzle, each momentary deformation of the diaphragm and electrode toward the nozzle and then away from the nozzle ejecting an ink droplet from the nozzle.

12. A multicolor magnetically actuated ink jet printer, comprising:

a plurality of ink jet printing devices, at least one for each of four colors of ink, each device having a substrate with at least one flexible membrane which serves as a diaphragm, an electrode for each diaphragm, a portion of which is aligned over and attached to the diaphragm, a nozzle plate bonded to the substrate with a cavity for each diaphragm and open thereto, the cavity containing a nozzle aligned above the diaphragm and an ink inlet, and at least one magnetic field generating means for generating a magnetic field of predetermined strength and direction;

a carriage on which each of the printing devices are mounted for translation thereby and therewith;

means to translate the carriage;

four separate, different colored ink supplies connected to the ink inlets of the cavity of each printing device to fill the cavities with a different one of the four colors of inks in said ink supplies; and means to selectively apply electric current to each of the electrodes.

13. The ink jet printer of claim 12, wherein the current pulse applied to each of the electrodes are perpendicular to the magnetic field direction, so that a momentary force on the electrodes is generated which first deforms the diaphragm then returns the diaphragm to a non-deformed state to eject an ink droplet.

14. A method of fabricating a magnetically actuated ink jet printing device, comprising the steps of:

(a) providing a planar substrate having first and second parallel surfaces;

(b) forming an array of metal electrodes on the substrate first surface, each electrode having an input terminal and an output terminal;

(c) passivating the electrodes;

(d) depositing a sacrificial layer of material on the substrate first surface and over the passivated electrodes;

(e) patterning the sacrificial layer to form a shape of an ink cavity on the substrate first surface for each electrode;

(f) depositing a layer of nozzle plate material on the substrate first surface and over the patterned sacrificial layer;

(g) forming a flexible membrane in the substrate for each electrode, the membranes having predetermined dimension and location, so that a portion of each electrode resides on each membrane;

(h) patterning the nozzle plate material to form a nozzle plate having a nozzle for each membrane and to remove the nozzle plate material from the electrode terminals;

(i) removing the sacrificial layer to form the ink cavities; and (j) mounting a magnetic field generating means adjacent at least one side of the substrate, so that a magnetic field generated thereby has a field direction perpendicular to the electrode portions residing on said membranes.

15. The method as claimed in claim 14, wherein step (a) comprises providing a silicon substrate having first and second parallel surfaces; and wherein step (f) comprises depositing a layer of photosensitive polyimide nozzle plate material.

16. The method as claimed in claim 15, step (g) further comprises the step of defining the locations of the membranes by doping portions of the silicon substrate first surface, to define a patterned etch stop that defines the locations of the diaphragms.

17. The method as claimed in claim 16, wherein step (g) comprises the steps of:

depositing an etch resistant layer on the substrate second surface;

patterning the etch resistant layer to provide vias therein exposing portions of the silicon substrate second surface; and anisotropically etching the exposed portions of the substrate second surface leaving the patterned etch stop.

18. The method as claimed in claim 17, wherein the step of defining the locations of the membranes comprises doping portions of the silicon substrate first surface to a predetermined thickness, to define etc stop membranes.

19. The method as claimed in claim 17, further comprising the step of:

depositing an etch resistant layer on the substrate first surface prior to step (b); and wherein the step of defining the locations of the membranes comprises doping portions of the substrate first surface to define non-doped non-etch stop areas which have the dimension of said membranes, so that the step of anisotropically etching etches through the silicon substrate in the non-etch stop areas to expose predetermined portions of the etch resistant layer on the substrate first surface, said exposed predetermined portions of the etch resistant layer forming the membranes for use as diaphragms.

20. The method as claimed in claim 17, wherein the etch resistant layer is silicon nitride; and wherein the step of patterning the etch resistant layer includes forming vias therein exposing portions of the substrate second surface that are located for etching ink inlets through the substrate to the ink cavities.

21. A magnetically actuated ink jet printing device for use in an ink jet printer, comprising:

a substrate having at least one flexible diaphragm therein;

at least one electrode formed on the substrate, a portion of the at least one electrode being overlying and attached to the at least one diaphragm;

a member formed on a surface of the substrate and having at least one internal cavity opening against the substrate surface which forms a part thereof, the cavity serving as an ink reservoir, said cavity having a nozzle and an ink inlet, the nozzle being aligned with the diaphragm;

at least one magnetic field generating means being located adjacent the substrate and oriented to generate a magnetic field of a predetermined strength and direction relative to the electrode over the diaphragm;

an ink supply connected to the ink inlet of the cavity to fill said cavity with ink; and means for selectively applying electrical current to the at least one electrode, the current through the electrode which is in the magnetic field producing a force which causes the diaphragm with the electrode to deform momentarily in a direction at least one of toward and away from the nozzle, each momentary deformation of the diaphragm and electrode ejecting an ink droplet from the nozzle.

22. The printing device as claimed in claim 21, wherein the substrate surface is a top surface and said substrate has a bottom surface substantially parallel to the top surface; and wherein the substrate bottom surface has at least one recess therein aligned with the at least one diaphragm.

23. The printing device as claimed in claim 22, wherein the substrate thickness is the distance between the top and bottom surfaces; wherein the at least one recess has a depth which is less than the substrate thickness; and wherein the at least one diaphragm is formed by a portion of the substrate having a thickness defined by the distance between the substrate top surface and the at least one recess.

24. The printing device as claimed in claim 23, wherein the substrate has a plurality of diaphragms and an equal number of aligned recesses; and wherein the equal number of aligned recesses are located in a second recess in the substrate bottom surface.

25. The printing device as claimed in claim 22, wherein the substrate thickness is the distance between the top and bottom surfaces; wherein the substrate top surface has a protective layer thereon; wherein the at least one recess has a depth which is equal to the substrate thickness, so that the recess exposes the protective layer; and wherein the at least one diaphragm is a portion of the protective layer exposed by the at least one recess.

26. The printing device as claimed in claim 25, wherein the substrate has a plurality of diaphragms and an equal number of aligned recesses; and wherein the equal number of aligned recesses are located in a second recess in the substrate bottom surface, the second recess having a depth which is less than the substrate thickness.

27. The printing device as claimed in claim 21, wherein the means for selectively applying electrical current to the at least one electrode, applies a current which causes the diaphragm with the electrode to deform momentarily in a direction toward and then away from the nozzle, each momentary deformation of the diaphragm and electrode toward the nozzle and then away from the nozzle ejecting an ink droplet from the nozzle.

* * * * *